US009517778B2

(12) United States Patent
Thompson

(10) Patent No.: US 9,517,778 B2
(45) Date of Patent: Dec. 13, 2016

(54) RAILWAY PASSENGER GATE ASSEMBLY

(71) Applicant: Kenneth I. Thompson, Monmouth Junction, NJ (US)

(72) Inventor: Kenneth I. Thompson, Monmouth Junction, NJ (US)

( * ) Notice: Subject to any disclaimer, the term of this patent is extended or adjusted under 35 U.S.C. 154(b) by 0 days.

(21) Appl. No.: 14/670,460

(22) Filed: Mar. 27, 2015

(65) Prior Publication Data

US 2016/0280237 A1 Sep. 29, 2016

(51) Int. Cl.

| | |
|---|---|
| ***B61B 1/02*** | (2006.01) |
| ***E01F 13/04*** | (2006.01) |
| ***E01F 13/06*** | (2006.01) |
| ***E05F 15/57*** | (2015.01) |
| ***E05F 15/53*** | (2015.01) |

(52) U.S. Cl.

CPC ..... *B61B 1/02* (2013.01); *E01F 13/046* (2013.01); *E01F 13/048* (2013.01); *E01F 13/06* (2013.01); *E05F 15/53* (2015.01); *E05F 15/57* (2015.01)

(58) Field of Classification Search

CPC ..... B61B 1/02; E05F 15/53; E05F 15/57; E01F 13/046; E01F 13/06; E01F 13/048

USPC ..... 49/49, 131, 372, 374; 404/4, 9

See application file for complete search history.

(56) References Cited

U.S. PATENT DOCUMENTS

| | | | | |
|---|---|---|---|---|
| 1,531,118 | A | 3/1925 | McManus | |
| 2,805,046 | A * | 9/1957 | Petterson | 256/25 |
| 4,576,508 | A | 3/1986 | Dickinson | |
| 4,666,331 | A * | 5/1987 | Riley | 404/6 |
| 4,922,655 | A * | 5/1990 | Seal | 49/131 |
| 4,998,843 | A | 3/1991 | Mothe | |
| 5,498,100 | A | 3/1996 | Guernsey | |
| 5,630,572 | A * | 5/1997 | Guay | 256/1 |
| 5,993,104 | A * | 11/1999 | Marcotullio et al. | 404/6 |
| 6,105,905 | A | 8/2000 | Spence | |
| 6,227,523 | B1 | 5/2001 | Haberten | |
| 6,926,462 | B1 | 8/2005 | Fuganti et al. | |
| 7,037,028 | B1 * | 5/2006 | Donohoe et al. | 404/6 |
| 7,568,857 | B2 * | 8/2009 | Riotto | 404/6 |
| D657,888 | S | 4/2012 | Darby | |
| 8,496,395 | B2 * | 7/2013 | Miracle | 404/6 |
| 8,985,890 | B2 * | 3/2015 | Miracle | 404/6 |
| 2003/0192253 | A1 * | 10/2003 | Miller et al. | 49/49 |

(Continued)

FOREIGN PATENT DOCUMENTS

| | | | |
|---|---|---|---|
| EP | 0632183 | A2 * | 1/1995 |
| EP | 0783054 | A1 * | 7/1997 |
| NL | 1000881 | C2 * | 1/1997 |

*Primary Examiner* — Jerry Redman

(57) ABSTRACT

A railway passenger gate assembly includes a platform having a well extending into a surface thereof. A housing is positioned within the well and has an open apex flush with the upper surface. A pair of vertically oriented cylinders is positioned within the housing. A conduit is in fluid communication with each of the cylinders. Each of the cylinders has one of a pair of pistons positioned therein. The pistons each have a bottom end and a top end. Each of the top ends has one of a pair of posts attached thereto. A railing is attached to and extends between the posts. The pistons are movable from a stored position with the railing being approximately flush with the upper surface or in a deployed position positioned above the upper surface. A pump in fluid communication with the cylinders forces fluid into the cylinders to urge the pistons upwardly.

6 Claims, 7 Drawing Sheets

(56) References Cited

U.S. PATENT DOCUMENTS

| | | | | |
|---|---|---|---|---|
| 2005/0031411 | A1* | 2/2005 | Hensley | 404/11 |
| 2007/0068078 | A1* | 3/2007 | Hosokawa | 49/49 |
| 2010/0308294 | A1 | 12/2010 | Watkins | |

* cited by examiner

RAILWAY PASSENGER GATE ASSEMBLY

BACKGROUND OF THE DISCLOSURE

Field of the Disclosure

The disclosure relates to gate devices and more particularly pertains to a new gate device for preventing persons from falling off a train platform.

SUMMARY OF THE DISCLOSURE

An embodiment of the disclosure meets the needs presented above by generally comprising a platform that has an upper surface. A well extends downwardly into the platform. The well is positioned adjacent to an edge of the platform positioned nearest to a train track. A housing is positioned within the well and has an open apex. The apex is approximately flush with the upper surface of the platform. A pair of cylinders is positioned within the housing and each of the cylinders is vertically oriented. A conduit is in fluid communication with each of the cylinders. Each of the cylinders has one of a pair of pistons positioned therein. Each of the pistons has a bottom end and a top end.

Each of the top ends has one of a pair of posts attached thereto such that the posts extend upwardly from the pistons. A railing is attached to and extends between the posts. The railing is positioned on an upper end of the posts and is horizontally oriented. The pistons are movable from a stored position with the railing being approximately flush with the upper surface or in a deployed position positioned greater than 30.0 inches above the upper surface. A pump is in fluid communication with the cylinders to force fluid into the cylinders and urge the pistons upwardly into the deployed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
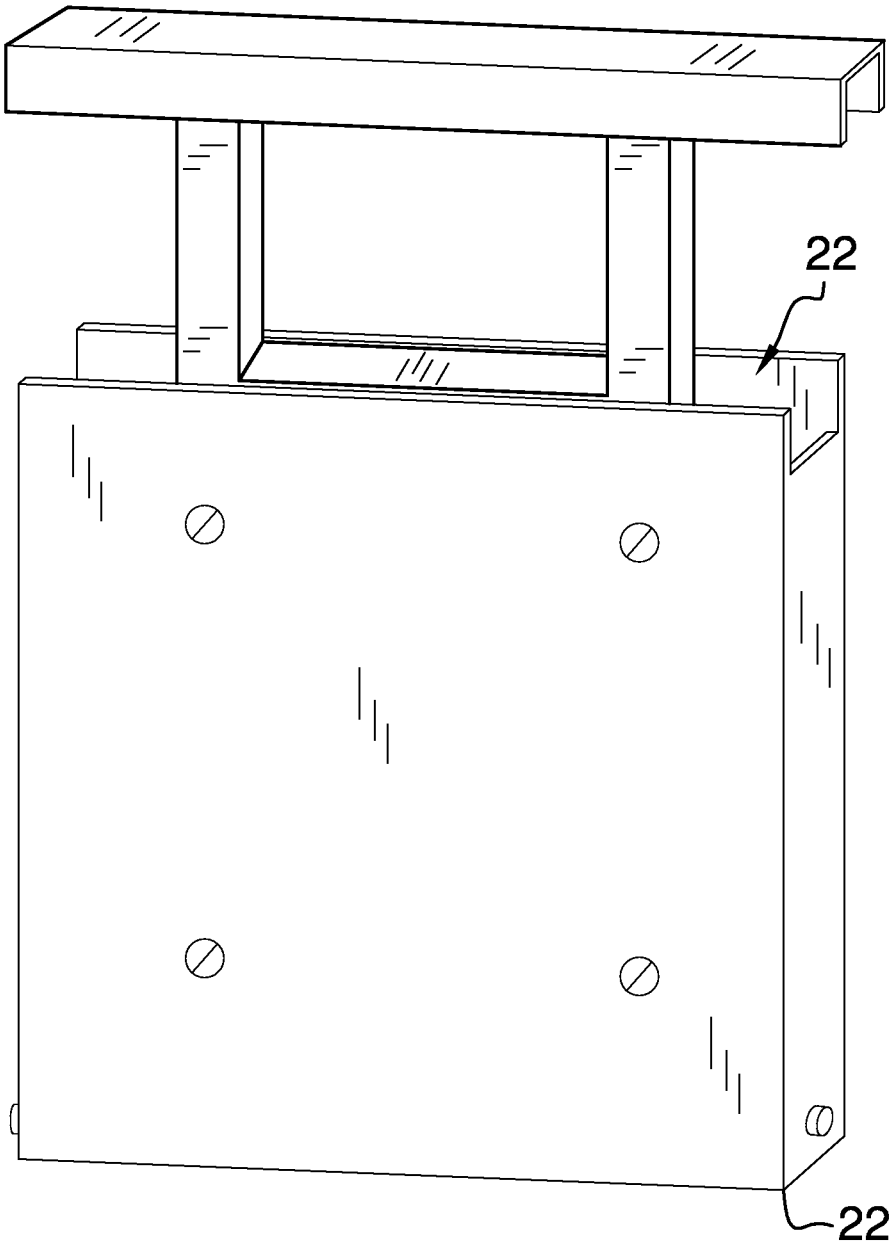
FIG. 1 is a front perspective view of a housing of a railway passenger gate assembly according to an embodiment of the disclosure.

With reference now to the drawings, and in particular to FIGS. 1 through 8 thereof, a new gate device embodying the principles and concepts of an embodiment of the disclosure and generally designated by the reference numeral 10 will be described.

As best illustrated in FIGS. 1 through 8, the railway passenger gate assembly 10 generally comprises a platform 12 that has an upper surface 14. A well 16 extends downwardly into the platform 12, though the well 16 may be formed, or defined, around the remainder of a housing 20 as will be further explained below. The well 16 is positioned adjacent to an edge of the platform 12 positioned nearest to a train track 18. More particularly, the well 16, and therefore the housing 20, may be positioned in areas adjacent to where persons would board a train.

The housing 20 is positioned within the well 16 and has an apex 22 which is open. The apex 22 is approximately flush with the upper surface 14 of the platform 12. A pair of cylinders 24 is positioned within the housing 20 and each of the cylinders 24 is vertically oriented. A conduit 26 is in fluid communication with each of the cylinders 24. A pair of pistons 30 is provided and each of the cylinders 24 has one of the pistons 30 positioned therein. A pump 28 is in fluid communication with the cylinders 24, and more particularly in fluid communication with the conduit 26, to force fluid into the cylinders 24 and urge the pistons 30 upwardly into the deployed position. The fluid may be a liquid or a gas, i.e. hydraulic or pneumatic. The conduit 26 may include an inlet valve 32 and an outlet valve 34, which are one-way valves, for allowing fluid flow into the conduit by way of the inlet valve 32 and outwardly of the conduit 26 through the outlet valve 34. However the fluid may instead be drawn outwardly through the conduit 26 from the same direction it was delivered into the conduit by reversal of the pump 28 or by utilization of two pumps working in opposite fluid flow direction. The outlet 34 and inlet 32 valves may each be fluidly coupled to a reservoir 33 such that a total pressure of a contained system is defined. It should be understood that the assembly 10 may comprise a plurality of housings 20 each having a conduit 26 with the conduits 26 fluidly coupled together wherein a single pump 28 therewith in an interconnected system. Thus, the number of housing 20 and conduit 26 combinations used within the apparatus 10 may be altered as needed. The total pressure may therefore include pressure within a single conduit 26 or multiple ones thereof. Further, an interconnected system may include a plurality of conduits 26 fluidly coupled together but only a single inlet valve 32 and a single outlet valve 34.

The pistons 30 each have a bottom end 36 and a top end 38. A pair of posts 40 is provided. Each of the top ends 38 has one of the posts 40 attached thereto such that the posts 40 extend upwardly from and outwardly of the pistons 24. A railing 42 is attached to and extending between the posts 40. The railing 42 is positioned on an upper end 44 of the posts 40 and the railing 42 is horizontally oriented. The pistons 30 are movable from a stored position with the railing 42 being approximately flush with the upper surface 14 or in a deployed position positioned greater than 30.0 inches above the upper surface 14. Thus, in the deployed position the railing 42 provides a barrier to stop persons from falling onto the train track 18. A brace 46 may be attached to and extends between the posts 40. The brace 46 is positioned between the pistons 30 and the railing 42. The brace 46 adds strength to the assembly 10 as well as prevents children from stepping easily under the railing 42.

Each of the cylinders 24 includes a cylinder gasket 48 mounted on the cylinder 24 and extending around a corresponding one of the posts 40. The cylinder gaskets 48 are airtight and each of the cylinder gaskets 48 includes a plurality of cleaning bristles 50 for cleaning the posts 40 before the posts 40 move inwardly of the cylinders 24. This will prevent dust and debris, which falls into the housing 12 when the railing 42 is raised and lowered from the housing 20, from moving into the cylinders 24. Additional cleaning bristles 51 may be positioned outside of the cylinders 24 and extended around the posts 40.

Figure 6:
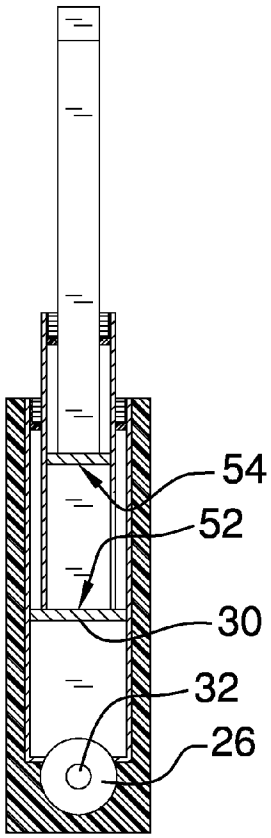
FIG. 6 is a side cross-sectional view of an embodiment of the disclosure.
Figure 5:
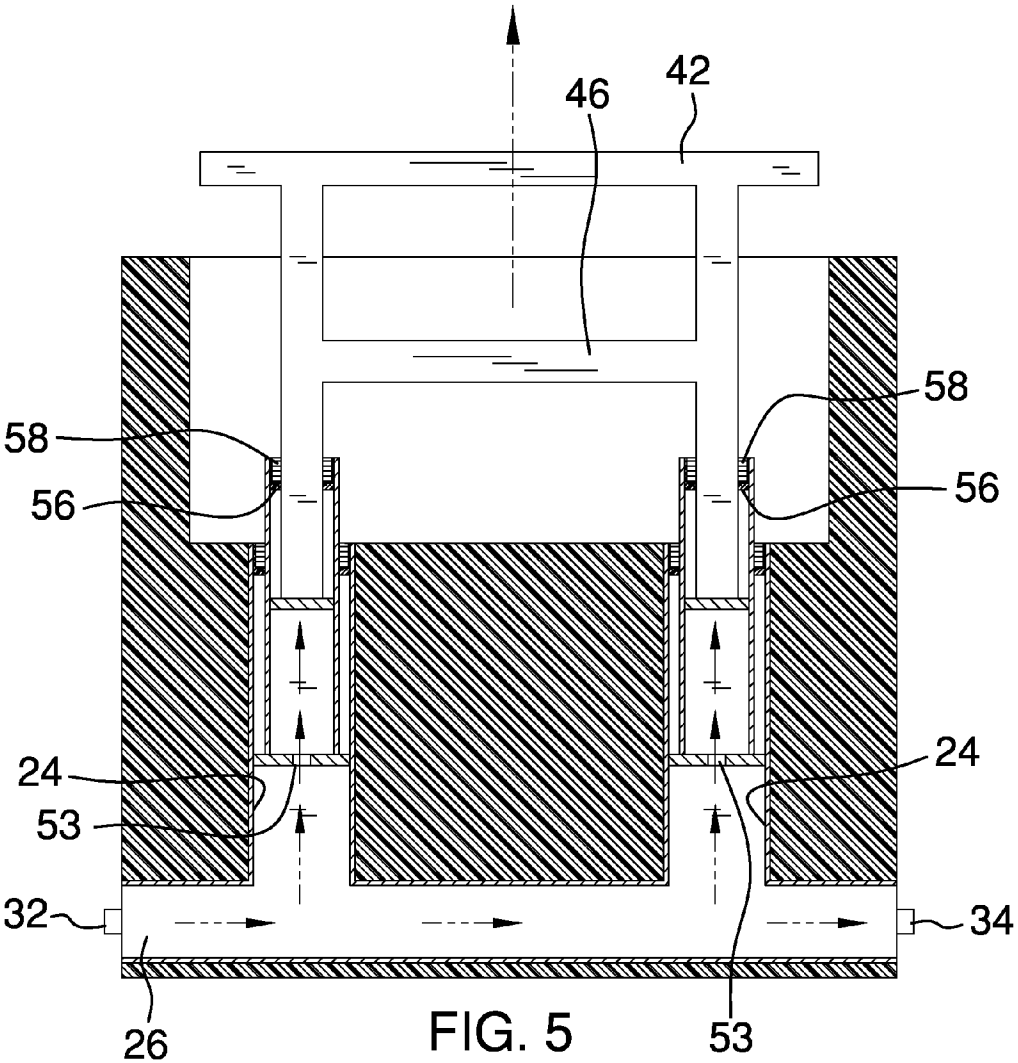
FIG. 5 is a front cross-sectional view of an embodiment of the disclosure.
Figure 7:
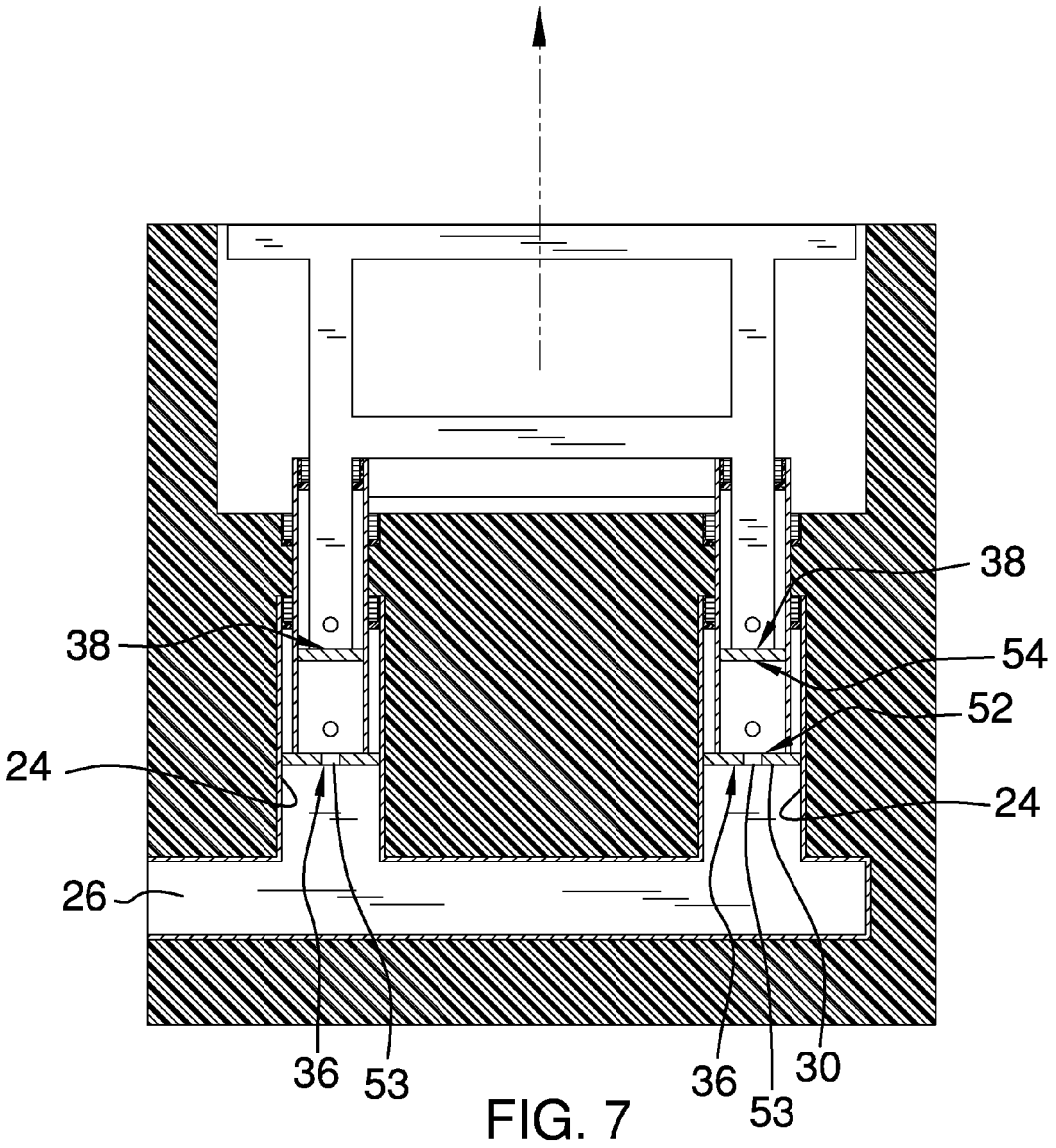
FIG. 7 is a front cross-sectional view of an embodiment of the disclosure.
Figure 8:
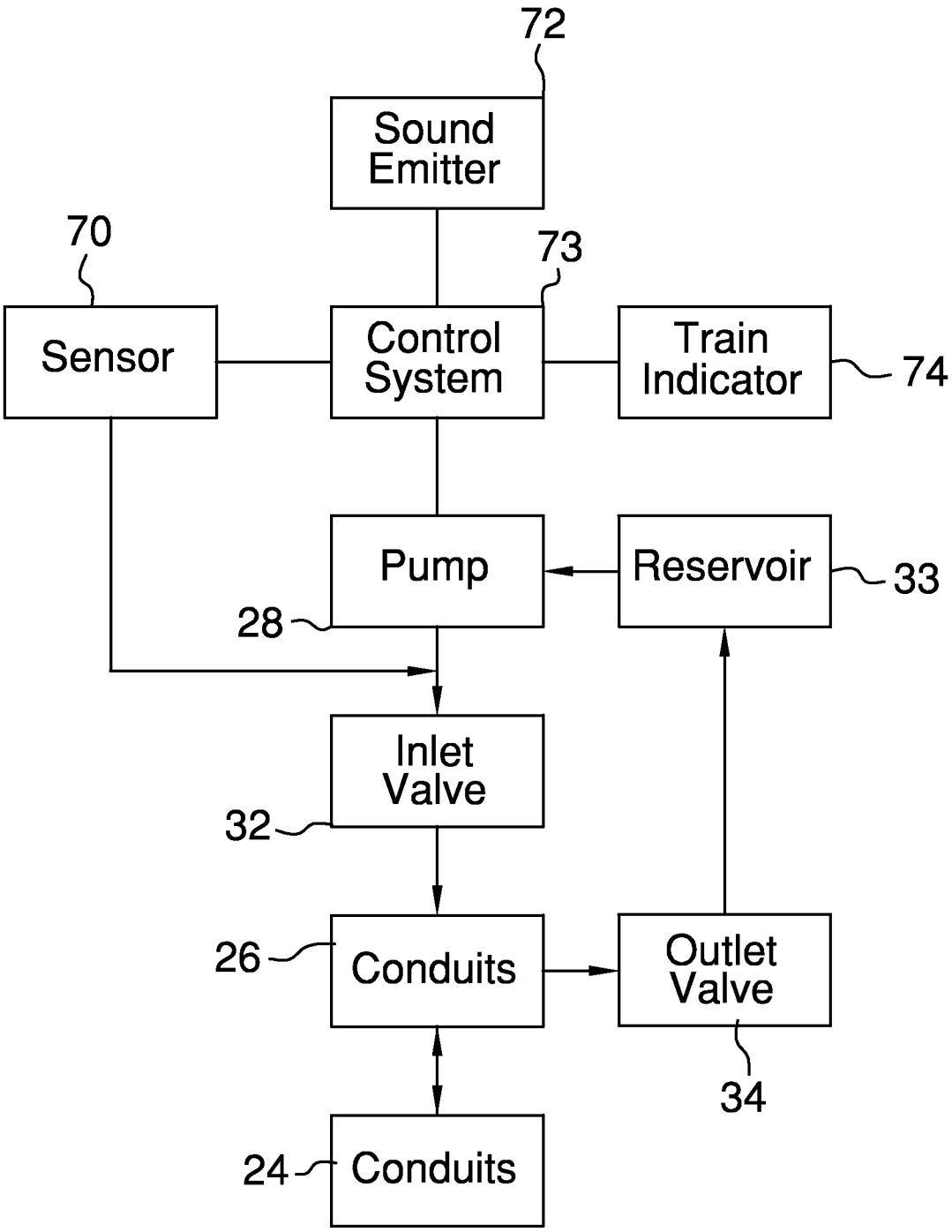
FIG. 8 is a schematic view of an embodiment of the disclosure.

In a version shown in FIGS. 5 and 6, each of the pistons 30 is telescopic and includes a lower section 52 and an upper section 54 in fluid communication, by way of apertures 53, with each other such that the upper sections 54 are lifted upwardly when a fluid is injected into the cylinders 24 and a corresponding one of the pistons 30. More particularly, fluid will move to lift the lower section 52 relative to the cylinder 24 and the fluid will then move into the upper section 54 to extend the upper section 54 outwardly of the lower section 52. The upper sections 54 are attached to an associated one of the posts 40. A pair of piston gaskets 56 is provided. Each of the piston gaskets 56 is positioned between one of the upper sections 54 and a corresponding one of the posts 40. The piston gaskets 56 are airtight and each of the piston gaskets 56 includes a plurality of bristles 58 for cleaning the posts 40 before the upper sections 54 move inwardly of the lower sections 52. FIG. 7 shows an embodiment wherein the upper section 54 extends through a solid portion of the housing 20 to further insulate the cylinders 24 from the posts 40. A similar structure is found in FIG. 3 with the posts 40.

Figure 2:
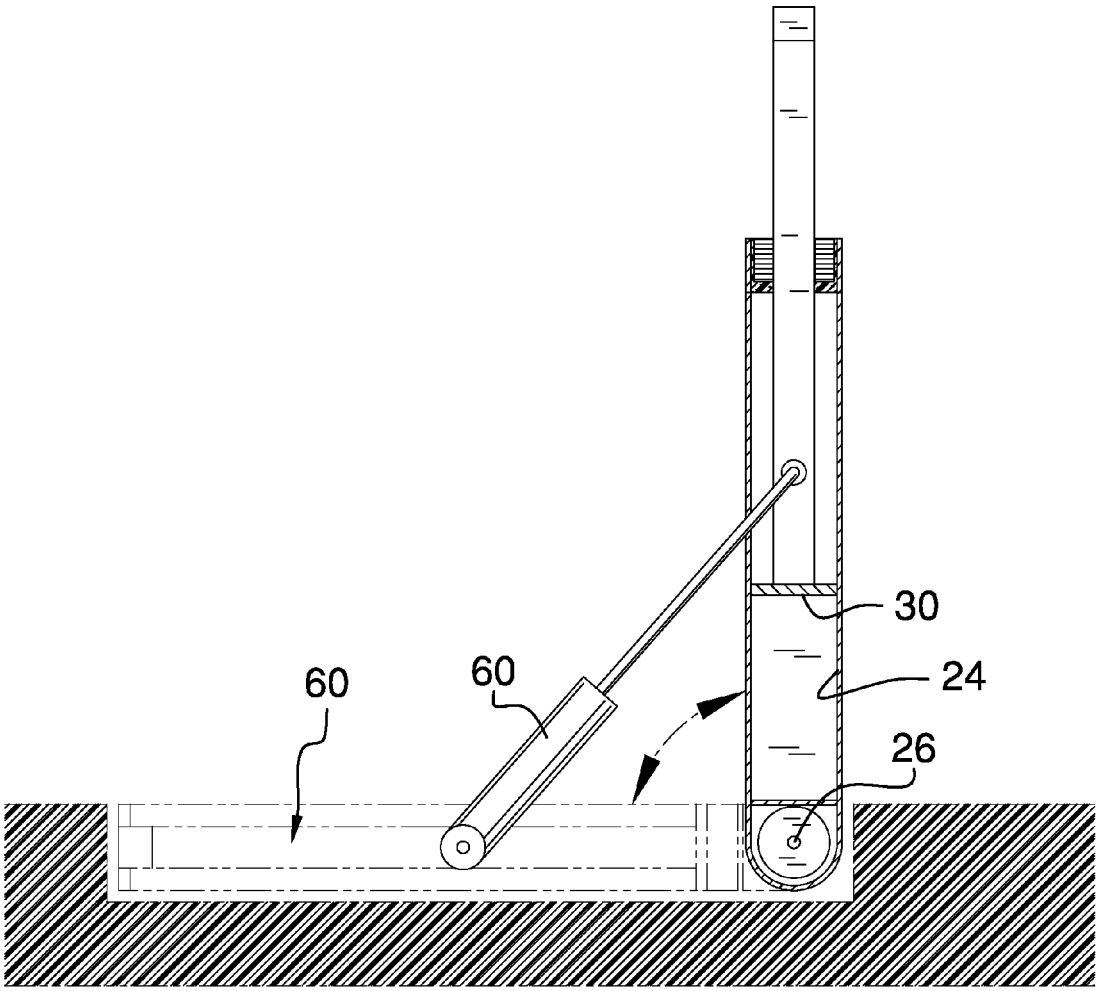
FIG. 2 is a cross-sectional view of an embodiment of the disclosure.
Figure 3:
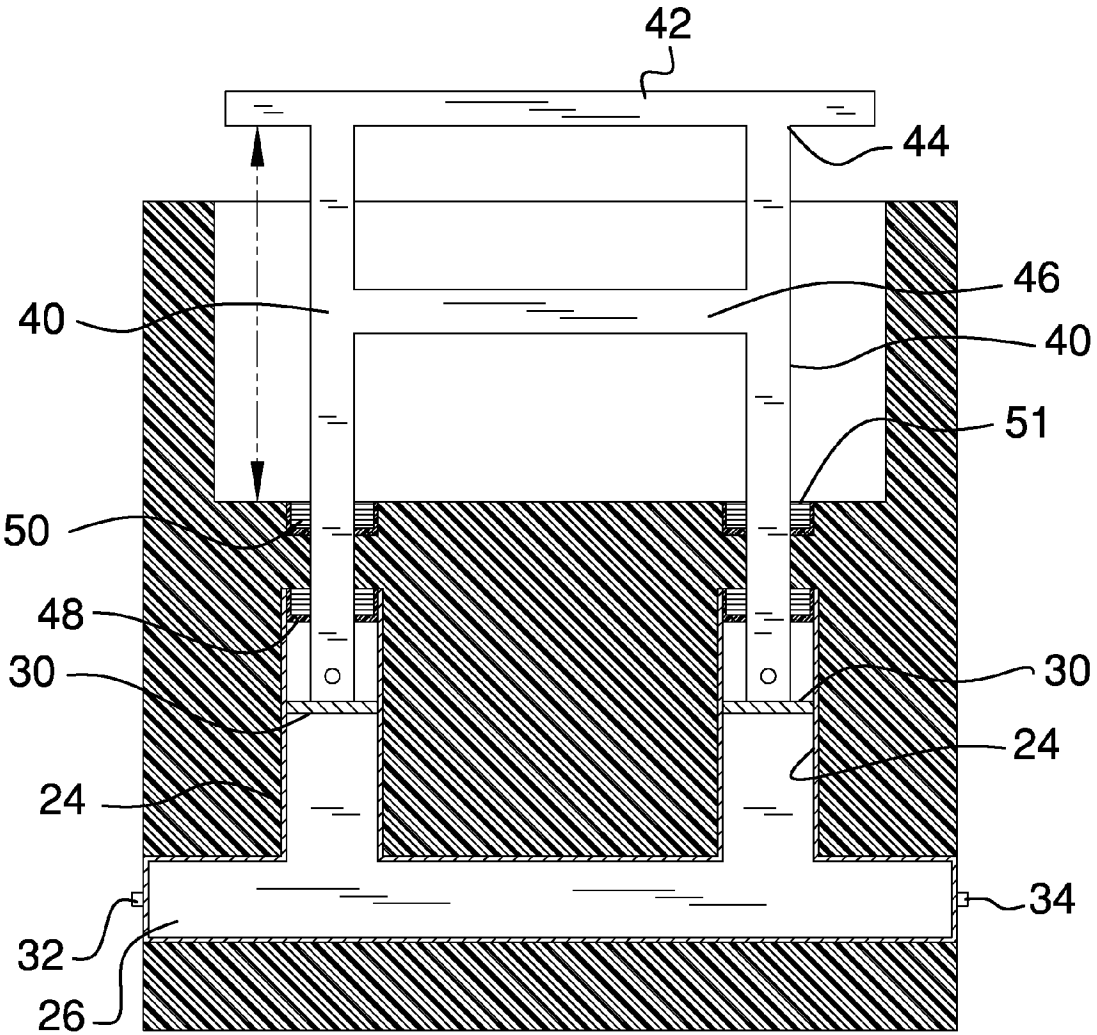
FIG. 3 is front a cross-sectional view of an embodiment of the disclosure.
Figure 4:
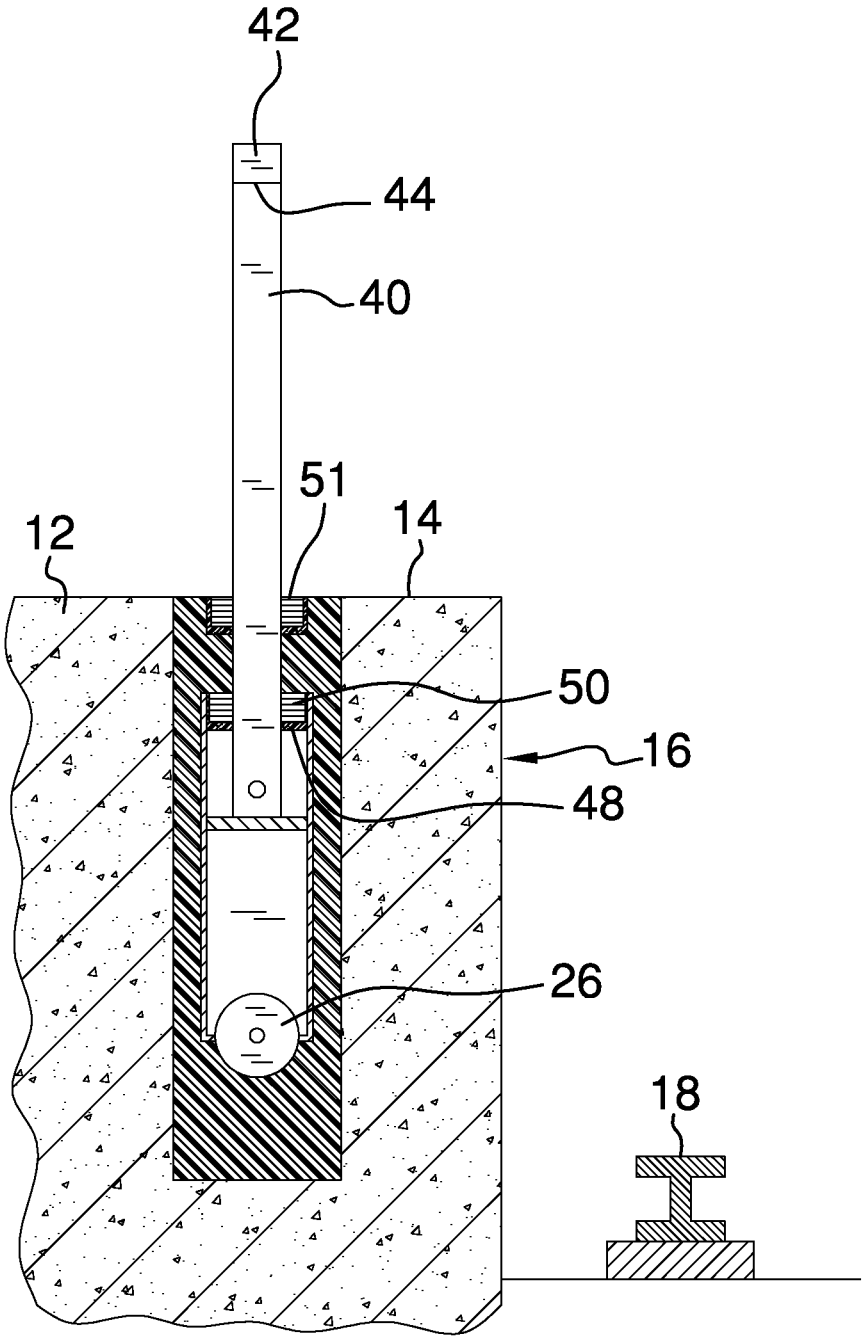
FIG. 4 is a side cross-sectional view of an embodiment of the disclosure.

FIG. 2 depicts a separate embodiment wherein the housing 20 lies flat within a well 58 such that the posts 40 are horizontally oriented. The posts 40 are then lifted to a vertical orientation with an actuator 60, which may comprise a hydraulic, pneumatic or electric lift. Once lifted to an upright position, the pistons 30 may be raised as with the other embodiments.

The apparatus 10 may include a pressure sensor 70 in fluid communication with the conduits. The pressure sensor 70 is operationally coupled to a control system 73, which would include a conventional processor, to selectively control the pump 28, inlet valve 32 and/or outlet valve 34 to decrease or stop the increasing of pressure within the conduit 26 should the pressure sensor 70 detect pressure greater than a preselected threshold. Generally an increase in the pressure beyond that needed to lift the railing 42 would indicate that a person is standing on the railing 42. The pressure sensor 70 thus prevents the lifting of the railing 42 when a person is standing on the railing 42. Should a plurality of conduits 26 be fluidly coupled together, the pressure sensor 70 may stop the raising of all associated railings 42 or a plurality of pressure sensors 70 may be used such that only the railings 42 having weight thereon will not lift.

A sound emitter 72 may be operationally coupled to the control system 73 such that the control system 73 causes the sound emitter 72 to emitter audible warnings that the railing 42 is being raised. The audible warnings may include conventional type siren or chiming sounds and/or recorded messages indicating that the railings 42 are going to be raised.

A train indicator 74 may be operationally coupled to the control system 73 such that the pump 28 is only actuated to lift the railing 42 when a train is positioned adjacent the platform 14. The train indicator 74 may be one of multiple indicators 74 to detect the train being stopped along a selected portion of the platform 14.

In use, the posts 40 are lifted and raised as needed to provide protection for persons on the platform 12. In particular, when there is no train stopped adjacent to the platform 12, the posts 40 will be retained in their upright position preventing easy access to the train track 18. When a train stops adjacent to the platform 12, the posts 40 are lowered to allow travelers to pass the assembly and enter the train. The posts 40 will be actuated using inlet and exhaust valves coupled to the conduit 26 and which may be active by the control system coordinated with the arrival and departure of the train.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A barrier system for a railway station platform, said system comprising:

a platform having an upper surface, a well extending downwardly into said platform, said well being positioned adjacent to an edge of said platform;

a housing being positioned within said well and having an apex being open, said apex being approximately flush with said upper surface of said platform;

a pair of cylinders being positioned within said housing, each of said cylinders being vertically oriented, a conduit being in fluid communication with each of said cylinders;

a pair of pistons, each of said cylinders having one of said pistons positioned therein, each of said pistons having a bottom end and a top end;

a pair of posts, each of said top ends having one of said posts attached thereto such that said posts extend upwardly from said pistons;

a railing being attached to and extending between said posts, said railing being positioned on an upper end of said posts, said railing being horizontally oriented;

said pistons being movable between a stored position with said railing being approximately flush with said upper surface and a deployed position positioned greater than 30.0 inches above said upper surface;

a pump being in fluid communication with said cylinders to force fluid into said cylinders and urge said pistons upwardly into said deployed position; and a brace being attached to said and extending between said posts, said brace being positioned between said pistons and said railing.

2. The barrier system according to claim 1, further including a brace being attached to said and extending between said posts, said brace being positioned between said pistons and said railing.

3. The barrier system according to claim 1, further including each of said cylinders including a cylinder gasket mounted on said cylinder and extending around a corresponding one of said posts, each of said cylinder gaskets including a plurality of cleaning bristles for cleaning said posts before said posts move inwardly of said cylinders.

4. The barrier system according to claim 1, further including each of said pistons being telescopic and including a lower section and an upper section in fluid communication with each other such that said upper sections are lifted upwardly when a fluid is injected into said cylinders and a corresponding one of said pistons, said upper sections being attached to an associated one of said posts.

5. The barrier system according to claim 4, further including a pair of piston gaskets being provided, each of said piston gaskets being positioned between one of said upper sections and a corresponding one of said posts, each of said piston gaskets including a plurality of bristles for cleaning said posts before said posts move inwardly of said lower sections.

6. A barrier system for a railway station platform, said system comprising:

a platform having an upper surface, a well extending downwardly into said platform, said well being positioned adjacent to an edge of said platform;

a housing being positioned within said housing and having an apex being open, said apex being approximately flush with said upper surface of said platform;

a pair of cylinders being positioned within said housing, each of said cylinders being vertically oriented, a conduit being in fluid communication with each of said cylinders;

a pair of pistons, each of said cylinders having one of said pistons positioned therein, each of said pistons having a bottom end and a top end;

a pair of posts, each of said top ends having one of said posts attached thereto such that said posts extend upwardly from said pistons;

a railing being attached to and extending between said posts, said railing being positioned on an upper end of said posts, said railing being horizontally oriented;

said pistons being movable between a stored position with said railing being approximately flush with said upper surface and a deployed position positioned greater than 30.0 inches above said upper surface;

a brace being attached to and extending between said posts, said brace being positioned between said pistons and said railing;

each of said cylinders including a cylinder gasket mounted on said cylinder and extending around a corresponding one of said posts, each of said cylinder gaskets including a plurality of cleaning bristles for cleaning said posts before said posts move inwardly of said cylinders;

each of said pistons being telescopic and including a lower section and an upper section in fluid communication with each other such that said upper sections are lifted upwardly when a fluid is injected into said cylinders and a corresponding one of said pistons, said upper sections being attached to an associated one of said posts;

a pair of piston gaskets being provided, each of said piston gaskets being positioned between one of said upper sections and a corresponding one of said posts, each of said piston gaskets including a plurality of bristles for cleaning said posts before said posts move inwardly of said lower sections; and a pump being in fluid communication with said cylinders to force fluid into said cylinders and urge said pistons upwardly into said deployed position.

* * * * *